US006911118B2

(12) United States Patent
Selin

(10) Patent No.: US 6,911,118 B2
(45) Date of Patent: Jun. 28, 2005

(54) PULPER FOR PRODUCING PAPER PULP FROM WASTE PAPER

(75) Inventor: Roland Selin, Bromma (SE)

(73) Assignee: JLR Pulping Systems AB, Bromma (SE)

( * ) Notice: Subject to any disclaimer, the term of this patent is extended or adjusted under 35 U.S.C. 154(b) by 180 days.

(21) Appl. No.: 10/239,088

(22) PCT Filed: Mar. 21, 2001

(86) PCT No.: PCT/SE01/00606

§ 371 (c)(1),
(2), (4) Date: Jan. 6, 2003

(87) PCT Pub. No.: WO01/73194

PCT Pub. Date: Oct. 4, 2001

(65) Prior Publication Data

US 2004/0011490 A1 Jan. 22, 2004

(30) Foreign Application Priority Data

Mar. 24, 2000 (SE) ..... 0001053

(51) Int. Cl.[7] ..... D21C 7/00

(52) U.S. Cl. ..... 162/233; 162/261; 162/234; 162/4; 162/55; 162/57; 241/79.3; 241/79.2; 241/24.1; 241/24.11

(58) Field of Search ..... 162/233, 261, 162/234, 4, 55, 57; 241/79.3, 79.2, 38, 24.1, 24.11, 24.13, 24.15

(56) References Cited

U.S. PATENT DOCUMENTS 4,052,009 A * 10/1977 Penque ..... 241/1

FOREIGN PATENT DOCUMENTS

EP 0 530 124 3/1993

* cited by examiner

*Primary Examiner*—Mark Halpern
(74) *Attorney, Agent, or Firm*—Young & Thompson

(57) ABSTRACT

A pulper for producing paper pulp from waste paper containing undesired scrap particles includes a container (1) forming a chamber (4) defined by a bottom wall (5) and a cylindrical circumferential wall (6). A paper tearing member (7) is arranged in the chamber closed to the bottom wall and is rotatable in a horizontal direction of rotation about the centre axis of the cylindrical wall. The bottom wall and the circumferential wall forms a substantially circular peripheral reject chute (11) situated under the paper tearing member for collecting reject including undesired scrap particles. The reject chute extends helically in the direction of rotation of the paper tearing member from an upper end (12) of the reject chute downwardly to a lower end (13) of the reject chute. The circumferential wall (6) has a substantially cylindrical shape and extends vertically to the reject chute (11). A discharge element (2) is adapted to discharge reject in batches from the reject chute.

8 Claims, 2 Drawing Sheets

PULPER FOR PRODUCING PAPER PULP FROM WASTE PAPER

This application is a 371 of application PCT/SE01/00606 filed on 21 Mar. 2001.

BACKGROUND OF THE INVENTION

The present invention relates to a pulper for producing paper pulp from waste paper containing undesired scrap particles. The pulper comprises a container forming a chamber for receiving waste paper and water. The chamber is defined by a bottom wall and a substantially cylindrical circumferential wall. The pulper further comprises a paper tearing member provided in the chamber closed to the bottom wall and rotatable in a horizontal direction of rotation about the centre axis of the cylindrical wall. The bottom wall and the circumferential wall form a substantially circular peripheral reject chute situated under the paper tearing member for collecting reject including undesired scrap particles and extending helically in the direction of rotation of the paper tearing member from an upper end of the reject chute to a lower end of the reject chute, the circumferential wall extending vertically to the reject chute. A discharge pipe is connected to the reject chute at the lower end thereof and a conveyer screw is arranged in the discharge pipe for discharging reject in batches from the reject chute.

Traditionally, pulpers are used in the pulp and paper making industry as a first process step to initially fragmentize and disintegrate the waste paper, which usually is delivered in bales, in water, so that a primary paper pulp is obtained. The primary paper pulp usually contains a great deal of undesired relatively large scrap particles, such as glass, stone, metal, plastic and the like. Such undesired scrap particles are removed from the primary paper pulp already in the pulper with the aid of a strainer that only permits passage of paper pulp and smaller impurities.

A problem of the traditional pulpers however is that also relatively large scrap particles are disintegrated by the rotating paper tearing member into smaller particles that are able to pass through the strainer of the pulper, which makes it more difficult to clean the primary paper pulp in the subsequent cleaning steps. EP 0414602 A2 discloses a known pulper of the kind initially described that partly eliminates this problem. Thus, the container according to the known pulper has a traditional, conically designed wall portion of the circumferential wall extending downwardly to the reject chute, and a reject outlet for continuous discharge of reject from the reject chute. Undesired large scrap particles are intended to separate to the reject chute and be discharged continuously from this via the outlet.

However, the known pulper is not capable of satisfactorily preventing large scrap particles from being disintegrated by the paper tearing member. In addition, some released fibres are lost through the reject outlet, which is a drawback.

SUMMARY OF THE INVENTION

The object of the present invention is to provide a pulper that efficiently prevents disintegration of relatively large scrap particles and minimises the lost of fibres.

This object is obtained by a pulper of the kind initially described characterised in that the conveyer screw comprises a coreless conveyer screw and that the discharge pipe is horizontal.

The conveyer screw has an inlet end and an outlet end, wherein the conveyer screw is journalled at the inlet end thereof in a manner such that it is radially moveable at its outlet end. The fact that the conveyor screw is coreless and radially moveable at its outlet end means that the discharged pipe is efficiently prevented from being clogged by long particles such as plastic shreds that rotate along with the conveyor screw. Suitably, a drive means is adapted to intermittently rotate the conveyor screw to discharge reject in batches from the reject chute.

The discharge pipe preferably extends substantially tangentially towards the circular reject chute and at its lower end is provided with an upper radial hole, through which reject passes from the reject chute into the discharge pipe. A dewatering means for dewatering reject fed out from the discharge pipe may comprise an inclined pipe, which at is lower end is connected to the discharge pipe, a dewatering screw extending in the pipe for feeding reject to the upper end of the pipe, and a strainer arranged on the pipe at its upper end for separating water from the reject.

To disturb the vortex generated in the mixture of torn paper and water in the container of the pulper, as the paper tearing member is rotated, the generally cylindrical wall may comprise a preferably plane wall portion forming a radial constriction in the chamber of the container. The constriction makes it difficult for the vortex to form a central air column that reaches down to the strainer that normally is arranged under the rotating paper tearing member. As a result a large volume of finished paper pulp can be pumped from the container before air from the air column of the vortex disturbs the function of the used pump.

BRIEF DESCRIPTION OF THE DRAWINGS

The invention is explained in more detail in the following reference to the accompanying drawings, in which.

DETAILED DESCRIPTION OF THE PREFERRED EMBODIMENTS

Figure 1:
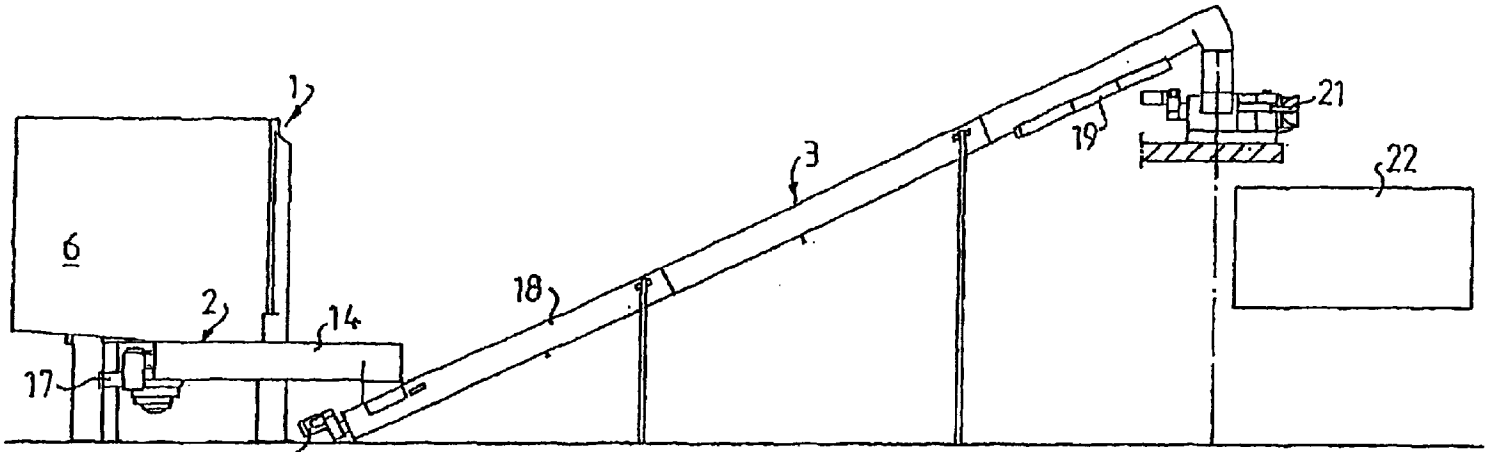
FIG. 1 shows a side view of a pulper according to the invention.
Figure 2:
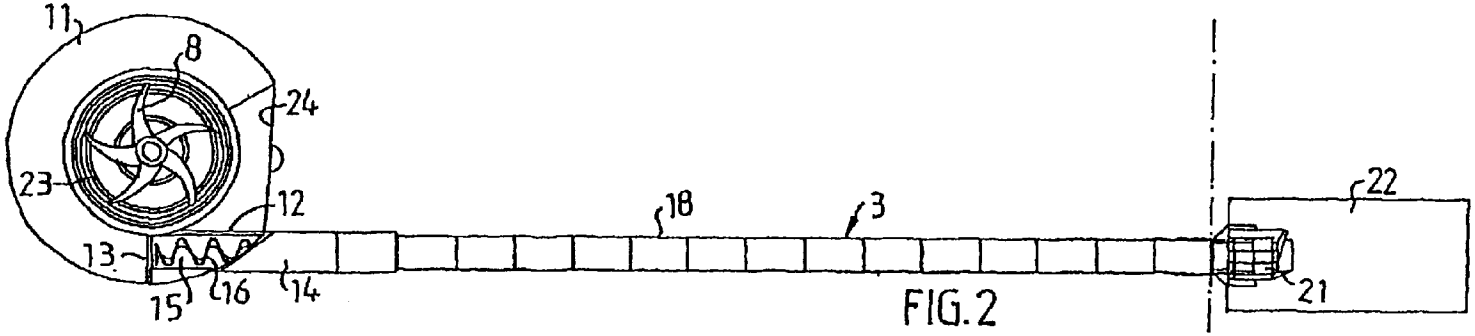
FIG. 2 shows a view from above of the pulper according to FIG. 1.
Figure 3:
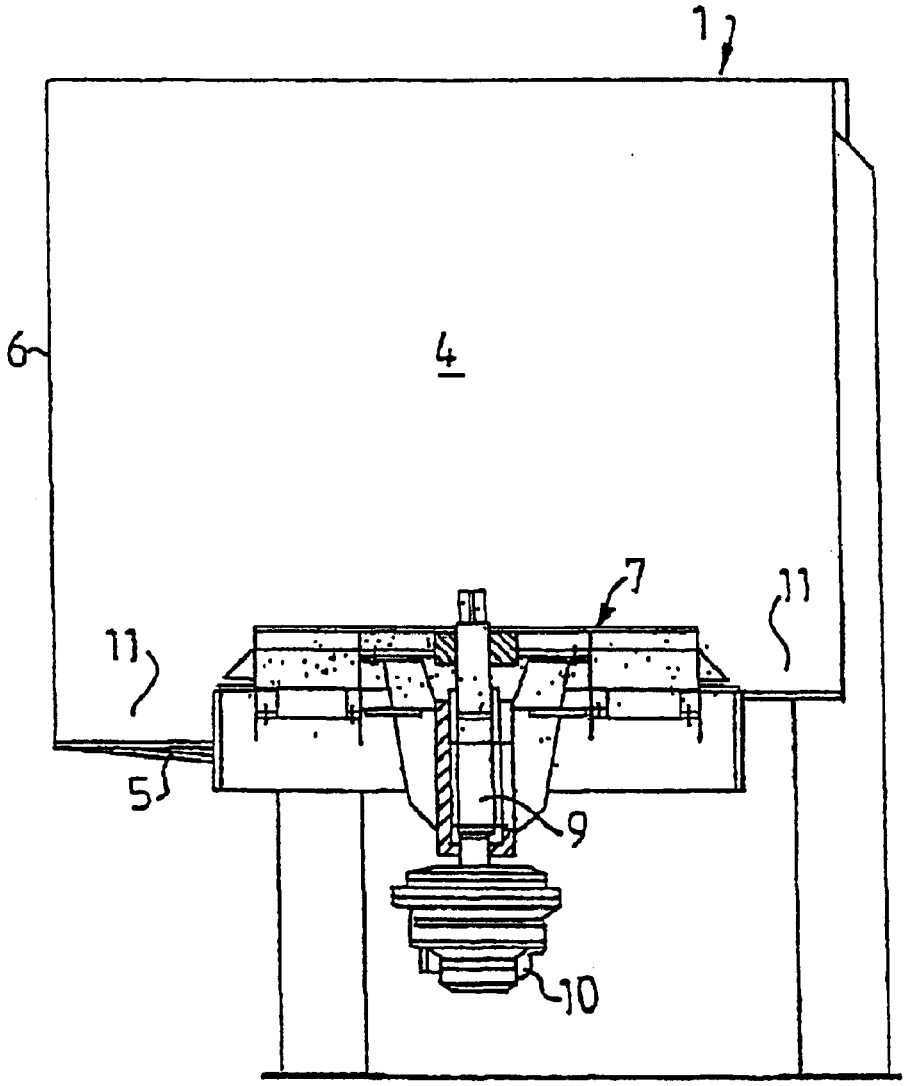
FIG. 3 shows a sectional side view of an enlarged detail of the pulper according to FIG. 1.

FIG. 1 shows a pulper according to the invention comprising a container 1 for receiving waste paper bales in batches, a discharge means 2 for discharging reject in batches from the container 1 and a dewatering means 3 for dewatering discharge reject. The container 1 forms a chamber 4 defined by a bottom wall 5 and a vertical cylindrical circumferential wall 6, see FIG. 3. The cylindrical circumferential wall 6 has a diameter of about 5 meter and comprises a plane wall portion 24, which forms a radial constriction in the chamber 4. A paper tearing member 7 with five knife blades 8 is attached to a vertical rotor shaft 9 journalled centrally on the bottom wall 5 and rotatable by a motor 10.

The bottom wall 5 and the cylindrical circumferential wall 6 form a circular peripheral reject chute 11 situated under the paper tearing member 7. The reject chute 11 extends helically in the direction of rotation of the paper tearing member 7 from an upper end 12 of the reject chute 11 to a lower end 13 of the reject chute 11.

The discharge means 2 comprises a straight horizontal discharge pipe 14 extending substantially tangentially towards the cylindrical circumferential wall 6 and situated under the reject chute 11. The interior of the discharge pipe 14 is connected to the reject chute 11 at its lower end 13 via an upper hole 15 in the discharge pipe 14. A coreless conveyor screw 16 extends in the discharge pipe 11 and is rotatable by a motor 17. At its inlet end the conveyor screw 16 is journalled on the shaft of the motor 17 in such a manner that it is somewhat radially moveable at its outlet end.

The dewatering means 3 comprises a pipe 18 extending obliquely upwardly from the discharge pipe 14, a dewatering screw arranged in the pipe 18 and a strainer 19 arranged on the under side of the pipe 18 close to the upper end of the pipe 18. The dewatering screw is driven by a motor 20 situated at the lower end of the pipe 18. The discharge pipe 14 and the obliquely upwardly extending pipe 18 are connected to each other so that a closed passage for reject is formed in the latter. A screw press 21 is arranged to receive reject that is conveyed out of the pipe 18. A reject container 22 is placed under the screw press 21 for receiving compressed reject.

In operation, the paper tearing member 7 is rotated by the motor 10 at a speed of about 100–200 rpm and the container 1 is filled with a number of waste paper bales. Water is supplied to the container concurrently with the continuous disintegration of the paper, so that finally a primary paper pulp with a desired fibre concentration has been obtained, for example between 8–15%. Then valves, not shown, are opened so that the paper pulp can be pumped out from the container through the coreless strainer 23 situated centrally under the paper tearing member 7. During the discharge of the paper pulp the vortex in the paper pulp is disturbed by the plane wall portion 24, so that substantially all of the paper pulp can be pumped out from the container 1. The course of events described above can normally take about 90 minutes.

During the disintegration of the paper pulp present scrap particles are released, which scrap particles are pulled by centrifugal force radially outwardly to the vertical circumferential wall where they sink by gravity down to and accumulate in the reject chute 11. After discharge of paper pulp and before a new batch of waste paper is supplied to the container 1 accumulated reject may be discharged. Discharge of reject takes place by activating the motors 17 and 20 at the same time as rinsing water is supplied to the container 1 and the paper tearing member 7 is rotated. The reject in the lower end 13 of the reject chute 11 is pressed down through the hole 15 and its captured by the conveyor screw 16, which conveys the reject to the upwardly obliquely extending pipe 18. In this the dewatering screw feeds the reject further up to a level above the liquid mixture in the container 1. At this level the reject is dewatered when it passes the strainer 19. The dewatered reject is discharged from the upper end of the pipe 18 to the screw press 21, which compresses the reject. Finally the compressed reject is discharged from the screw press 21 to the reject container 22. After accomplished reject discharge the motors 17 and 20 are stopped, and then a new batch of waste paper can be supplied to the container 1.

What is claimed is:

1. A pulper for producing paper pulp from waste paper containing undesired scrap particles, comprising:

a container forming a chamber for receiving waste paper and water, said chamber being defined by a bottom wall and a substantially cylindrical circumferential wall, a paper tearing member, which is arranged in said chamber close to said bottom wall and which is rotatable in a horizontal direction of rotation about a center axis of said cylindrical wall, said bottom wall and said circumferential wall forming a substantially circular peripheral reject chute, which is situated under said paper tearing member for collecting reject including undesired scrap particles and which extends helically in the direction of rotation of said paper tearing member from an upper end of said reject chute downwardly to a lower end of said reject chute, a horizontal discharge pipe connected to said reject chute at said lower end thereof, and a coreless conveyer screw in said horizontal discharge pipe for discharging reject in batches from said reject chute, said coreless conveyor screw having an inlet end and an outlet end, wherein said conveyor screw is journalled in such a manner at said inlet end so that said conveyor screw is radially moveable at said outlet end.

2. A pulper according to claim 1, wherein the interior of said discharge pipe is connected to said reject chute at said lower end thereof via an upper hole in said discharge pipe, whereby reject passes from said reject chute into said discharge pipe via said upper hole.

3. A pulper according to claim 1, wherein said discharge pipe extends substantially tangentially toward said circular circumferential wall of said container.

4. A pulper according to claim 1, further comprising a drive means adapted to intermittently rotate said conveyor screw to discharge reject in batches from said reject chute.

5. A pulper according to claim 1, further comprising a dewatering means for dewatering reject that is fed out of said discharge pipe.

6. A pulper according to claim 5, wherein said dewatering means comprises a declining pipe, which at its lower end is connected to said discharge pipe, a dewatering screw extending in said declining pipe for feeding reject to the upper end of said declining pipe, and a strainer arranged on said declining pipe at its upper end for separating water from the reject.

7. A pulper according to claim 1, wherein said substantially cylindrical wall comprises a wall portion forming a radial constriction in said chamber of said container.

8. A pulper according to claim 7, wherein said wall portion is plane.

* * * * *